United States Patent [19]

D'Antonio et al.

[11] Patent Number: 4,964,486

[45] Date of Patent: Oct. 23, 1990

[54] CINDER BLOCK MODULAR DIFFUSOR

[75] Inventors: Peter D'Antonio, Largo, Md.; John H. Konnert, Reston, Va.

[73] Assignee: RPG Diffusor Systems, Inc., Largo, Md.

[21] Appl. No.: 431,834

[22] Filed: Nov. 6, 1989

[51] Int. Cl.[5] ..... F04B 1/02; G10K 11/26

[52] U.S. Cl. ..... 181/285; 181/286; 181/288; 181/290; 181/293

[58] Field of Search ..... 181/198, 285, 286, 288, 181/290, 293

[56] References Cited

U.S. PATENT DOCUMENTS 4,821,839 4/1989 D'Antonio et al. ..... 181/198

OTHER PUBLICATIONS

M. R. Schroeder, Self-Similarity and Fractals in Science and Art, J. Audio Eng. Soc., vol. 37 No. 10, Oct. 1989, pp. 795, 806.

*Primary Examiner*—Benjamin R. Fuller

*Attorney, Agent, or Firm*—H. Jay Spiegel

[57] ABSTRACT

The present invention relates to an acoustical diffusor device which is made up of a plurality of specially designed and shaped cinder or concrete blocks which may be assembled together through the use of mortar to provide a diffusor of desired shape and configuration. Each diffusor includes a plurality of wells, the depths of which are determined through the use of number theory sequences, such as the quadratic-residue sequence developed by Karl Frederick Gauss. These surface irregularities arenique in that they provide a flat power spectrum and constant scattered energy in the diffraction directions.

7 Claims, 4 Drawing Sheets

CINDER BLOCK MODULAR DIFFUSOR

BACKGROUND OF THE INVENTION

The present invention relates to a cinder block modular diffusor. Acoustic diffusors are known per se. In this regard, reference is made to applicants, U.S. Pat. No. D-291,601 issued Aug. 25, 1987. Furthermore, applicants, Patent Application Ser. No. 07/037,244 discloses a sound-absorbing diffusor using the quadratic-residue number theory, as well as sound-absorbing materials to absorb sound in a controlled manner. Applicants also have a pending Design Patent Application, Ser. No. 07/008,430, filed Jan. 29, 1987, and directed to an acoustical diffusor having a plurality of wells of approximately square cross-section.

None of the inventions disclosed in the above-listed patent applications and patent teach the concept of making of an acoustic diffusor device of a plurality of specially designed cinder blocks assembled together to form a completed diffusor.

Further, applicant is aware of a product sold under the trademark SOUNDBLOX which resemble cinder blocks and which include, wells therein not made in accordance with number theory sequences. Furthermore, these devices differ from the teachings of the present invention as being specifically designed to absorb sound rather than shape sound. In this regard, these masonry units include narrow openings allowing entry into internal chambers designed to absorb sound and control reverberation. Contrary to this, the teachings of the present invention only include narrow elongated wells which are specifically sized and configured in accordance with number theory sequences, i.e., the quadratic-residue sequence, to allow sound to escape therefrom in a manner which causes the shaping of the sound in a desired predetermined manner.

SUMMARY OF THE INVENTION

The present invention includes the following interrelated aspects and features:

(a) In a first aspect, the diffusors made in accordance with the teachings of the present invention include a plurality of wells, the respective depths of which are determined through operation of the quadratic-residue number theory sequence. The wells are of substantially equal widths as compared to one another and create a phase grating.

(b) The quadratic-residue number theory sequence is based upon a formula, $n^2$ (modulo N) where N is a prime number, developed by Karl Frederick Gauss. In the example used below, which is only exemplary, the modulus number chosen is 7. The sequence values for the wells numbered zero to n are determined by the remainder after dividing the well number squared by the modulus. The well depths are equal to the sequence value multiplied times a chosen constant x (see Table A).

$$x = \frac{\lambda_o}{2N},$$

where $\lambda_0$ is the lowest wavelength effectively diffused. Thus, in determining the depths of the individual wells, the square of the number of each well is compared to multiples of 7. Thus, with reference to Table A below, it should be clear, for example, that well number 3 has a depth of 2x where x is the constant chosen as desired to determine the actual depths of the wells. In the example of the third well, 32 equals 9 which when divided by the modulus number 7 equals 1 with a remainder of 2, so the depth of the third well will be 2x. In a further example, concerning the fifth well, 52 equals 25 which when divided by 7 (the modulus number) equals 3 with a remainder of 4, thus the fifth well will have a depth of 4x. It should be stressed that the number in Table A under the column headed $n^2$ (mod 7) is the residue or remainder after dividing $n^2$ by the modulus number 7.

TABLE A

| n | $n^2$ | $n^2$ (mod 7) | Depth | Well Depth Where x = 0.75" in inches |
|---|---|---|---|---|
| 0 | 0 | 0 | 0 | 0 |
| 1 | 1 | 1 | x | 0.75 |
| 2 | 4 | 4 | 4x | 3.00 |
| 3 | 9 | 2 | 2x | 1.50 |
| 4 | 16 | 2 | 2x | 1.50 |
| 5 | 25 | 4 | 4x | 3.00 |
| 6 | 36 | 1 | x | 0.75 |

(c) In the preferred embodiment of the present invention, a plurality of cinder blocks are manufactured having predetermined numbers of wells therein of predetermined depths in accordance with the quadratic-residue number theory sequence, which cinder blocks are assembled together to provide an integrated acoustic diffusor of desired length, width and height, and which acoustical diffusor is quite effective in shaping and controlling sound waves.

Accordingly, it is a first object of the present invention to provide an improved acoustical diffusor which is modular in nature.

It is a further object of the present invention to provide such an acoustical diffusor whose modular nature is caused by its manufacture through the use of a plurality of cinder blocks.

It is a yet further object of the present invention to provide such an acoustical diffusor wherein the cinder blocks are provided with wells of differing depths determined in accordance with the quadratic-residue number theory sequence.

It is a still further object of the present invention to provide such an acoustical diffusor which may be made of any desired size or configuration. If structural integrity is necessary, diffusor blocks can be staggered as shown in FIG. 1. If diffusor blocks are applied as fascia to an existing structural wall, staggering is not necessary and the lower row in FIG. 1 can be repeated using a single block shown in FIG. 2.

Full spectrum diffusors can be obtained by applying diffusor blocks, as shown in FIG. 2, to well faces of larger low frequency diffusors, described later, to extend the low frequency response.

These and other aspects, objects and features of the present invention will be better understood from the following detailed description of the preferred embodiment when read in conjunction with the appended drawing figures.

SPECIFIC DESCRIPTION OF THE PREFERRED EMBODIMENT

Figure 1:
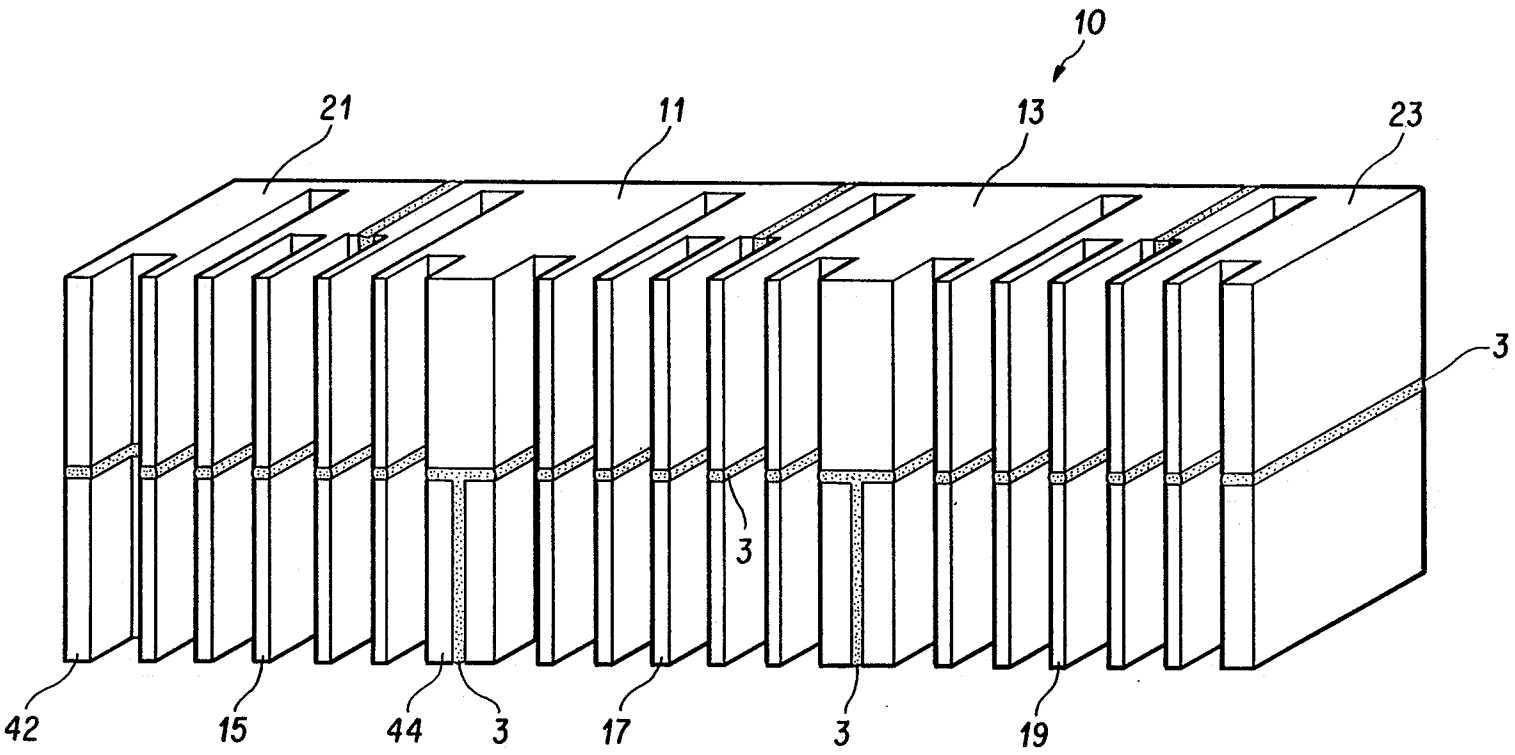
FIG. 1 shows a perspective view of an acoustical diffusor made in accordance with the teachings of the present invention.

With reference, first, to FIG. 1, it is seen that an acoustical diffusor is generally designated by the reference numeral 10 and is seen to include a plurality of cinder blocks 11, 13, 15, 17, 19, 21 and 23.

As should be understood from FIG. 1, the blocks 15, 17 and 19 are substantially identical to one another. Furthermore, the blocks 11, 13 are substantially identical to one another. Finally, the blocks 21 and 23 are left and right end caps, respectively.

Figure 2:
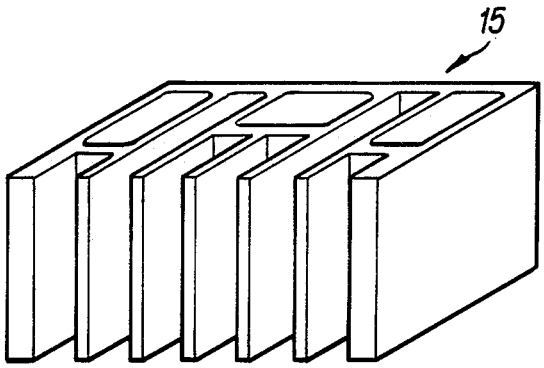
FIG. 2 shows a perspective view of one of the cinder blocks of the diffusor shown in FIG. 1.
Figure 3:
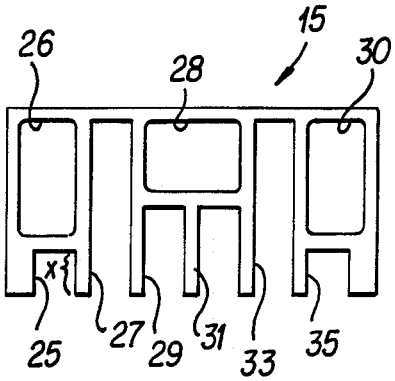
FIG. 3 shows a top view of the cinder block of FIG. 2.

With particular reference to FIGS. 2–5, the block 15 is shown in detail to include a plurality of wells 25, 27, 29, 31, 33 and 35 having differing depths with respect to one another as determined through implementation of the quadratic-residue number theory sequence. As best seen in FIG. 3, the depth of the well 25 is "x", as is the depth of the well 35. The depths of the wells 29 and 31 is 2x, while the depths of the wells 27 and 33 is 4x.

Figure 4:
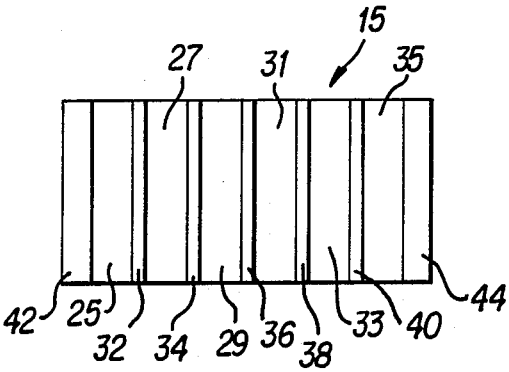
FIG. 4 shows a front view of the cinder block shown in FIGS. 2 and 3.
Figure 5:
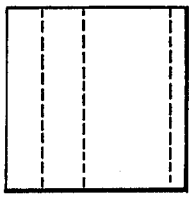
FIG. 5 shows a side view of the cinder block shown in FIGS. 2–4.

The block 15 also includes 3 internal chambers therein designated by the reference numerals 26, 28 and 30. These chambers in no way communicate with any of the wells of the block 15 but, rather, are provided for reinforcement bars or poured concrete to assure strength and rigidity in the block 15. As seen in FIG. 4 in particular, the dividing walls between respective wells designated by the reference numerals 32, 34, 36, 38 and 40 are thinner than the end walls designated by the reference numerals 42 and 44. With reference to FIG. 1, it should be understood that the divider 44 combines with a divider in the adjacent block 17, along with mortar, to propagate or join sequences of wells determined in accordance with the quadratic-residue number theory sequence.

With reference, now, to FIGS. 6–9, the block 11 is seen to include wells 51, 53, 55, 57 and 59 which are defined by respective divider walls 61, 63, 65, 67, 69 and 71. With particular reference to FIG. 1, it should be understood that for structural integrity, the blocks 21, 11, 13, and 23 are assembled on the blocks 15, 17, and 19 in a staggered overlapping relation through the use of mortar designated generally by the reference numeral 3. Thus, while the blocks 15, 17 and 19 each include a single well defined sequence of wells determined in accordance with the quadratic-residue number theory sequence, the blocks 21, 11, 13 and 23 only include portions of these sequences of wells and must be assembled together to provide complete such sequences. Thus, the divider wall 65 seen in FIGS. 6–9 divides between two well sequences, each of which is partially included in the block 11 and each of which relies upon adjacent blocks in the manner illustrated in FIG. 1 to complete each sequence.

Figure 6:
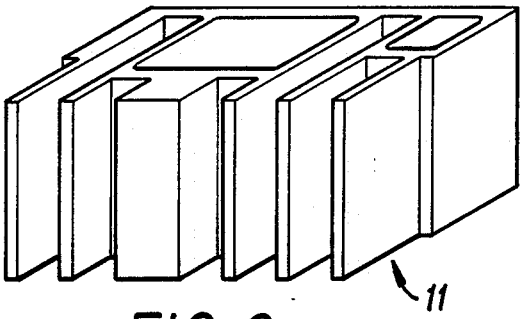
FIG. 6 shows a perspective view of a second one of the cinder blocks incorporated into the acoustical diffusor of FIG. 1.
Figure 7:
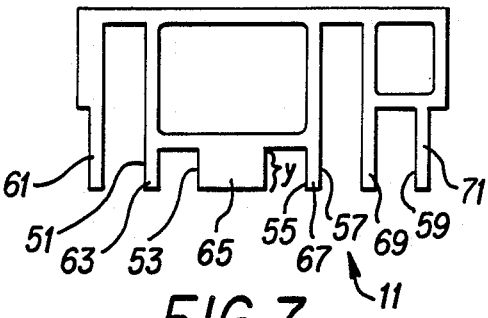
FIG. 7 shows a top view of the cinder block of FIG. 6.
Figure 8:
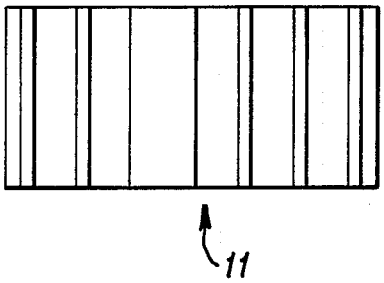
FIG. 8 shows a front view of the cinder block of FIGS. 6 and 7.
Figure 9:
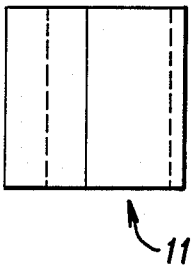
FIG. 9 shows a side view of the cinder block shown in FIGS. 6–8.
Figure 10:
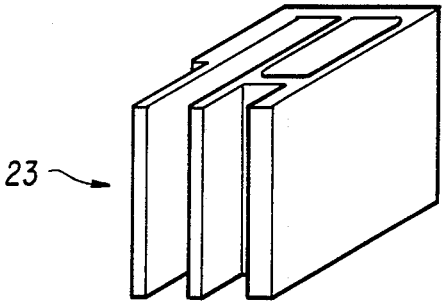
FIG. 10 shows a perspective view of a further cinder block illustrated in FIG. 1.
Figure 11:
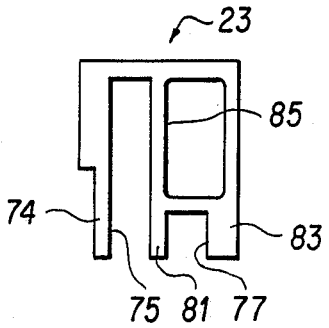
FIG. 11 shows a top view of the cinder block of FIG. 10.
Figure 12:
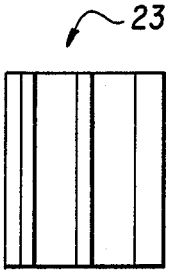
FIG. 12 shows a front view of the cinder block illustrated in FIGS. 10 and 11.
Figure 13:
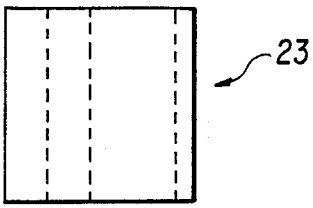
FIG. 13 shows a side view of the cinder block illustrated in FIGS. 10–12.
Figure 14:
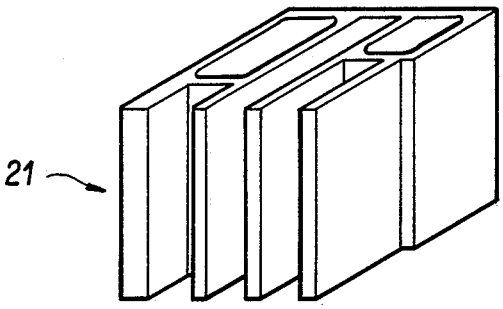
FIG. 14 shows a perspective view of a further cinder block illustrated in FIG. 1.
Figure 15:
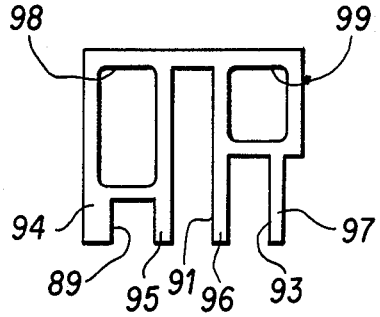
FIG. 15 shows a top view of the cinder block shown in FIG. 14.
Figure 16:
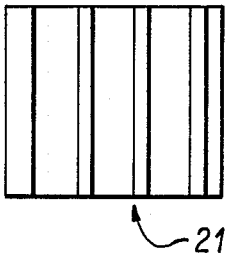
FIG. 16 shows a front view of the cinder block illustrated in FIGS. 14 and 15.
Figure 17:
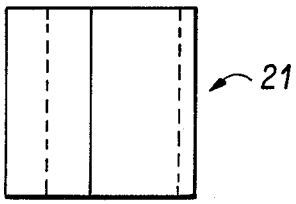
FIG. 17 shows a side view of the cinder block illustrated in FIGS. 14–16.

With further reference to FIGS. 6 and 7, the block 11 is seen to include two chambers 73 and 75 which are in no way connected with any of the wells thereof. The chambers 73 and 75 are provided merely to enhance the structural strength of the block 11 in the same manner as is the case with the block 15 illustrated in FIGS. 2–5.

As should be understood from FIG. 7 in particular, the well 55 has a depth "y" as does the well 53, where $y=x$ as x is depicted in FIG. 3. The well 59 has a depth of 2y, while the wells 51 and 57 have depths of 4y. As should be understood, when the block 11 is combined with the blocks 21, 13 and 23 as shown in FIG. 1, a complete row of wells consisting of three complete sequences thereof is provided.

With reference, now, to FIGS. 10–13, the block 23 is seen to include wells 75 and 77 defined by dividers 79, 81 and 83 and a chamber 85 which is completely isolated from the wells 75 and 77. Comparing FIGS. 10 and 11, in particular, with FIG. 1, it is seen that the wells 75 and 77 complete a well sequence which is commenced in the block 13.

Figure 18:
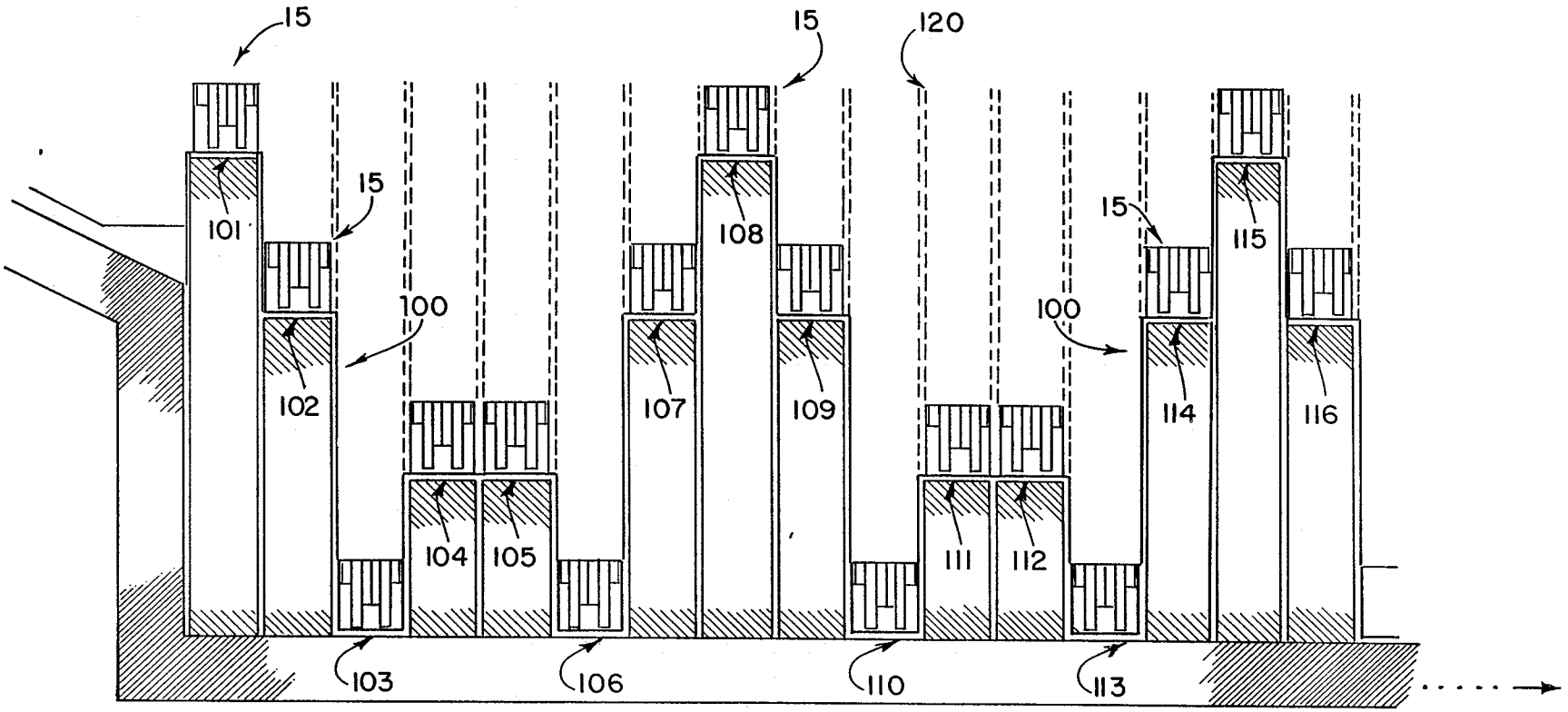
FIG. 18 shows an example of a full spectrum diffusor viewed from above.

With reference to FIGS. 14–17, the block 21 is seen to include wells 89, 91 and 93 defined by respective dividers 94, 95, 96 and 97. Further, the block 21 includes chambers 98 and 99 which are completely isolated from the wells 89, 91 and 93. Comparing FIGS. 18 and 19 with FIG. 1, it is seen that the wells 89, 91 and 93 commence, from left to right, a sequence of wells which is completed in the block 11.

As should be understood, from the above description, when the blocks 21, 11, 13, 23, 15, 17 and 19 are assembled together through the use of the mortar joints 3, an integrated acoustical diffusor is created which includes three sequences of wells determined in accordance with the quadratic-residue number theory and which may be integrated into the construction of a building. In particular, an acoustical diffusor made in accordance with the teachings of the present invention may be integrated into an exterior structural wall of a building or, if desired, may form an interior nonstructurally supportive wall. Alternatively, an acoustical diffusor such as that which is designated by the reference numeral 10 in FIG. 1 may be constructed in a manner so that it is not connected in any way with structural or nonstructural walls of a building.

Diffusor blocks can be used in conjunction with conventional cinder blocks, concrete or any other suitable massive and stiff building material to form a full spectrum diffusor. These hybrid structures as shown, for example, in FIG. 18 consist of a low frequency diffusor 100 (LFD), which forms the backbone, and diffusor blocks 15, as shown in FIG. 2, placed on the well faces of the LFD. The diffusor 100 has wells 101, 102, 103, 104, 105, 106, 107, 108, 109, 110, 111, 112, 113, 114, 115 and 116 which may, if desired, be separated by dividers 120. The LFD diffuses low frequencies and the diffusor blocks 15 diffuse mid and high frequencies, thus producing a full spectrum diffusor which can cover an appreciable portion of the audio spectrum. The well widths of the LFD 100 would be approximately 16" to accommodate a diffusor block 15 and the well depths are determined in accordance with TABLE A, with x equal to approximately 8" or more to provide low frequency efficiency. Said another way, the low frequency diffusor 100 is a massive structure with wells 101–116, the depths of which are determined through use of a number theory sequence. The wells 101–116 are large enough to each receive a small diffusor 15 sized and configured to be mounted in wells 101–116, to diffuse mid and high frequencies, thus creating, in conjunction with the low frequency diffusor 100 a full spectrum diffusor.

The diffusor 100 is characterized as being fractal which means that said diffusor 100 is a highly fractured structure having a surface which possesses the property of self-similarity, i.e., looks the same under any form of magnification and therefore presenting the same configuration to hign frequency sounds as it presents to low frequency sound, since low frequency sounds are diffused by the low frequency diffusor portion thereof, while high frequency sounds are diffused equally effectively by the high frequency diffusor portion which consists of small diffusors 15 within each well of the LFD.

Accordingly, an invention has been disclosed in terms of a preferred embodiment thereof which fulfills each and every one of the objects of the invention as set forth above and provides an improved cinder block modular sound diffusor device which has significant advantages in versatility and effectiveness over the prior art.

Of course, various changes, modifications and alterations in the teachings of the present invention may be contemplated by those skilled in the art without departing from the intended spirit and scope of the present invention. Accordingly, it is intended that the present invention only be limited by the terms of the appended claims.

What is claimed is:

1. A cinder block modular diffusor comprising:

(a) a plurality of cinder blocks, each of which includes a plurality of wells, said wells being of particular depths with respet to one another which are determined by use of a quadratic-residue number theory sequence, wherein each consecutive well is given a number from 0 to n, where n equals one less than a total number of wells, and wherein a depth of any particular well is determined by squaring said number for said particular well and dividing said squared number by a chosen modulus number resulting in a remainder, the remainder after said dividing being multiplied by a chosen constant to arrive at said depth of said particular well, each of said cinder blocks including at least a portion of a complete sequence of wells;

(b) said cinder blocks being assembled together with mortar to combine together to comprise an integrated acoustical diffusor having said complete sequence of wells.

2. The modular diffusor of claim 1, wherein some of said cinder blocks have a partial sequence of wells while others of said cinder blocks have a complete said sequence of wells.

3. The modular diffusor of claim 1, including two rows of cinder blocks.

4. The modular diffusor of claim 3, wherein a first said row includes a plurality of first cinder blocks each of which has a complete sequence of wells.

5. The modular diffusor of claim 4, wherein a second said row includes a plurality of second cinder blocks each of which has a partial sequence of wells.

6. The modular diffusor of claim 5, wherein said first and second group of cinder blocks are assembled laterally staggered with respect to one another so that said diffusor includes at least two complete sequences of wells.

7. The modularo diffuser of claim 1, wherien said modulor diffusor comprises a low frequency

* * * * *